US010260812B2

(12) United States Patent
Gonzalez et al.

(10) Patent No.: US 10,260,812 B2
(45) Date of Patent: Apr. 16, 2019

(54) GRATE BAR FOR A PALLET CAR

(71) Applicant: Cast Steel Products LP, by its General Partner Cast Steel Products GP Ltd., Edmonton (CA)

(72) Inventors: Cristobal J. Gonzalez, Seffner, FL (US); Ray Hernandez, Jr., Tampa, FL (US)

(73) Assignee: Cast Steel Products LP, Edmonton (CA)

( * ) Notice: Subject to any disclaimer, the term of this patent is extended or adjusted under 35 U.S.C. 154(b) by 227 days.

(21) Appl. No.: 15/210,219

(22) Filed: Jul. 14, 2016

(65) Prior Publication Data

US 2017/0016672 A1 Jan. 19, 2017

Related U.S. Application Data

(60) Provisional application No. 62/193,845, filed on Jul. 17, 2015.

(51) Int. Cl.
*F27B 21/02* (2006.01)

(52) U.S. Cl.
CPC ..... *F27B 21/02* (2013.01)

(58) Field of Classification Search
CPC ..... F27B 21/02
USPC ..... 266/274, 277, 178, 180, 279; 432/137, 432/241
See application file for complete search history.

(56) References Cited

U.S. PATENT DOCUMENTS

| | | | | |
|---|---|---|---|---|
| 1,807,154 | A | 5/1931 | Ekstedt | |
| 3,861,659 | A * | 1/1975 | Evenstad | F27B 21/06 110/269 |
| 4,103,627 | A * | 8/1978 | Mainka | F23H 7/08 110/281 |
| 4,275,706 | A | 6/1981 | Pauli | |
| 6,217,318 | B1 | 4/2001 | De Giovanni Pache De Faria et al. | |
| 9,863,706 | B2 * | 1/2018 | Gonzalez | F27B 21/02 |
| 2014/0283718 | A1 * | 9/2014 | Penski | F23H 7/08 110/281 |

FOREIGN PATENT DOCUMENTS

| | | | | |
|---|---|---|---|---|
| WO | WO 2013060605 | * | 5/2013 | F27B 21/02 |

* cited by examiner

*Primary Examiner* — Scott R Kastler
*Assistant Examiner* — Michael Aboagye
(74) *Attorney, Agent, or Firm* — Boyle Fredrickson, S.C.

(57) ABSTRACT

A grate bar is provided for use in forming a grate bar assembly of a sintering pallet car. The grate bar comprises an elongate body having top surface for receiving a load, a pair of opposed arms, and a pair of opposed feet, with each arm and foot pair retaining the frame of the car therebetween. Each of a pair of peripheral spacers extends laterally away from the body to distance the body from a body of an adjacent grate bar. Each of a pair of central spacers is located between the peripheral spacers and extends laterally away from the body to distance the body from the body of the adjacent grate bar. At least one of the plane defined by a peripheral spacer top wall and the plane defined by a central spacer top wall is below the plane defined by the top surface of the elongate body.

26 Claims, 7 Drawing Sheets

GRATE BAR FOR A PALLET CAR

CROSS-REFERENCE TO RELATED APPLICATIONS

This application claims priority to U.S. Provisional Application No. 62/193,845, filed Jul. 17, 2015, which is hereby incorporated by reference in its entirety.

TECHNICAL FIELD

The present disclosure relates to a grate bar for a pallet car.

BACKGROUND

When pelletizing or sintering ore, the bulk material to be treated (for example iron ore or zinc ore) is loaded onto a pallet car where a plurality of cars forms an endless chain, also referred to as traveling grate. The pallet cars are filled with the bulk material and pass through various treatment stations, in which a thermal treatment of the material, such as drying, firing and cooling, is effected.

The pallet cars which are moved along an endless path into the sintering furnace experience high radiant heat as the material to be sintered is treated. The pallet cars experience substantial differential heating and cooling, in repetitive cycles, and as a consequence, their components tend to expand and contract leading to warping and cracking, as well as loosening of components relative to each other.

Pallet cars include a loading bay for receiving bulk material to be treated. The loading bay is subjected to harsh conditions. The floor of the loading bay, comprising a plurality of grate bars, supports the weight of the bulk material, Differential heating and cooling of grate bars can lead to warping, cracking and loosening of connections. As is expected, grate bars are subjected to very high temperatures and existing pallet cars are built with floors with air slots to permit venting of hot gases. An exemplary prior art grate bar is shown in FIG. 1. Prior art Grate bar comprises an elongate body 1 including a top surface for supporting bulk material to be treated, a pair of opposed arms 2, and a pair of opposed feet 3. A pair of peripheral spacers 4 extends laterally away from the body 1 in opposing directions by a spacer width.

A pair of central spacers 5 extend laterally, a certain distance, away from the body 1 in opposing directions by a spacer width. Central spacers 5 are located intermediate the opposed arms 2 of the grate bar.

The top wall of peripheral spacers 4 and central spacers 5 are flush with the top surface of the body 1 and therefore, the material to be treated contacts the top wall of spacers 4, 5.

Existing grate bar has length A and gap length L which is the combined distance (l+l) between each peripheral spacer on each end of the grate bar and the central spacer. A plurality of grate bars are placed in adjacent and abutting relationship with each other such that the peripheral spacers 4 and the central spacer 5 of one grate bar abuts against the peripheral spacers 4 and the central spacer 5, respectively, of an adjacently placed grate bar. Air slots 6 are formed in the space defined by paired peripheral spacers 4 and the central spacer 5 of adjacent grate bars. Air slots 6 allow for movement of gases between the adjacent grate bars. The width of air slots 6 is determined by the sum of the spacer widths of each adjacent grate bar. It will be appreciated that existing grate bars are bulky and thick and have poor venting characteristics and their use can result in warping, cracking and loosening of connections of the pallet car.

Therefore, there is a need to provide a grate bar for a sintering pallet car that overcomes the drawbacks of existing grate bars.

SUMMARY OF THE INVENTION

It is an embodiment of the present invention to provide a grate bar of a sintering machine pallet car.

According to an aspect, there is provided a grate bar for use in forming a grate bar assembly of a sintering pallet car, the assembly including a plurality of grate bars arranged in a side-by-side configuration, the grate bar comprising a body having a top surface for supporting a load, one or more spacers extending laterally from the body for contacting one or spacers of an adjacently placed grate bar, the spacers comprising a top wall which is recessed from the top surface of the body, and wherein when the grate bar is arranged adjacent in a side-by-side configuration with an adjacent grate bar, the spacers define a passageway for the movement of air between the adjacently arranged grate bars.

According to an aspect, there is provided a grate bar for use in forming a grate bar assembly of a sintering pallet car, the assembly including a plurality of grate bars arranged in a side-by-side configuration, the grate bar comprising:

- an elongate body having top surface for receiving a load, a pair of opposed arms, and a pair of opposed feet, wherein each arm and foot pair retain the frame of the car therebetween;
- a pair of peripheral spacers at the end of each arm, wherein each one of the pair of the peripheral spacers extends laterally away from the body to distance the body from a body of an adjacent grate bar, each one of the pair of peripheral spacers comprise:
  - a peripheral spacer top wall, a peripheral spacer bottom wall, and a peripheral spacer side wall joining the peripheral spacer top wall to the peripheral spacer bottom wall; and
- a pair of central spacers located between the peripheral spacers, each one of the pair of central spacers extends laterally away from the body to distance the body from the body of the adjacent grate bar, each one of the pair of central spacers comprises:
  - a central spacer top wall, a central spacer bottom wall, and a pair of central spacer sidewalls joining the central spacer top wall to the central spacer bottom wall, and
- wherein at least one of the plane defined by the peripheral spacer top wall and the plane defined by the central spacer top wall is below the plane defined by the top surface of the elongate body.

According to an aspect, there is provided a grate bar assembly for use in forming a floor, of a pallet car, the car having a frame the grate bar assembly comprising:

- a plurality of grate bars secured to the frame to form, a floor of a pallet car, the grate bars arranged in a side-by-side configuration, each one of the grate bars comprises a body having a top surface for supporting a load, one or more spacers extending laterally from the body for contacting one or spacers of an adjacently placed grate bar, the spacers comprising a top wall which is recessed from the top surface of the body, and wherein when the grate bar is arranged adjacent in a side-by-side configuration with an adjacent grate bar, the spacers define a passageway for the movement of air between the adjacently arranged grate bars an elongate body having top surface for receiving a load, a pair of opposed arms, and a pair of opposed feet wherein each arm and foot pair retain the frame of the car therebetween;

a pair of peripheral spacers at the end of each arm, wherein each one of the pair of the peripheral spacers extends laterally away from the body to distance the body from a body of an adjacent grate bar, each one of the pair of peripheral spacers comprise:

a peripheral spacer top wall, a peripheral spacer bottom wall, and a peripheral spacer side wall joining the peripheral spacer top wall to the peripheral spacer bottom wall;

a pair of central spacers located between the peripheral spacers, each one of the pair of central spacers extends laterally away from the body to distance the body from the body of the adjacent grate bar, each one of the pair of central spacers comprises:

a central spacer top wall, a central spacer bottom wall, and a pair of central spacer sidewalls joining the central spacer top wall to the central spacer bottom wall, an air slot formed between the body of adjacent grate bars, the air slot allowing for the movement of air through the floor, wherein the combined surface area of all the air slots comprise at least 10.5% of the total surface area of the floor.

According to an aspect, there is provided a grate bar assembly for use in forming a floor of a pallet car, the car having a frame, the grate bar assembly comprising:

a plurality of grate bars secured to the frame to form a floor of a pallet car, the grate bars arranged in a side-by-side configuration, each one of the grate bars comprises a body having a top surface for supporting a load, one or more spacers extending laterally from the body for contacting one or spacers of an adjacently placed grate bar, the spacers comprising a top wall which is recessed from the top surface of the body, and wherein when the grate bar is arranged adjacent in a side-by-side configuration with an adjacent grate bar, the spacers define a passageway for the movement of air between the adjacently arranged grate bars, and wherein the combined surface area of all the passageways comprise at least 10.5% of the total surface area of the floor.

According to an aspect, there is provided a grate bar assembly for use in forming a floor of a pallet car, the car having a frame, the grate bar assembly comprising:

a plurality of grate bars secured to the frame to form a floor of a pallet car, the grate bars arranged in a side-by-side configuration, each one of the grate bars comprises:

an elongate body having top surface for receiving a load, a pair of opposed arms, and a pair of opposed feet, wherein each arm and foot pair retain the frame of the car therebetween;

a pair of peripheral spacers at the end of each arm, wherein each one of the pair of the peripheral spacers extends laterally away from the body to distance the body from a body of an adjacent grate bar, each one of the pair of peripheral spacers comprise:

a peripheral spacer top wall, a peripheral spacer bottom wall, and a peripheral spacer side wall joining the peripheral spacer top wall to the peripheral spacer bottom wall;

a pair of central spacers located between the peripheral spacers, each one of the pair of central spacers extends laterally away from the body to distance the body from the body of the adjacent grate bar, each one of the pair of central spacers comprises:

a central spacer top wall, a central spacer bottom wall, and a pair of central spacer sidewalls joining the central spacer top wall to the central spacer bottom wall, an air slot formed between the body of adjacent grate bars, the air slot allowing for the movement of air through the floor, wherein the combined surface area of all the air slots comprise at least 10.5% of the total surface area of the floor.

DETAILED DESCRIPTION

Figure 1:
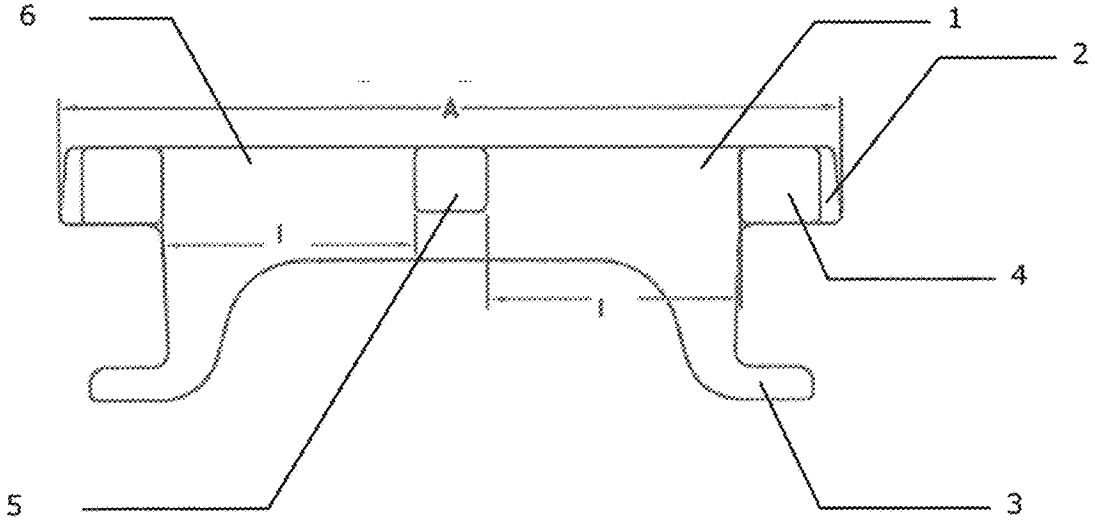
Prior Art FIG 1
FIG. 1 is a front elevation view of a prior art grate bar.

Reference will be made below in detail to exemplary embodiments of the invention, examples of which are illustrated in the accompanying drawings. Wherever possible, the same reference numerals used throughout the drawings refer to the same or like parts.

Figure 2:
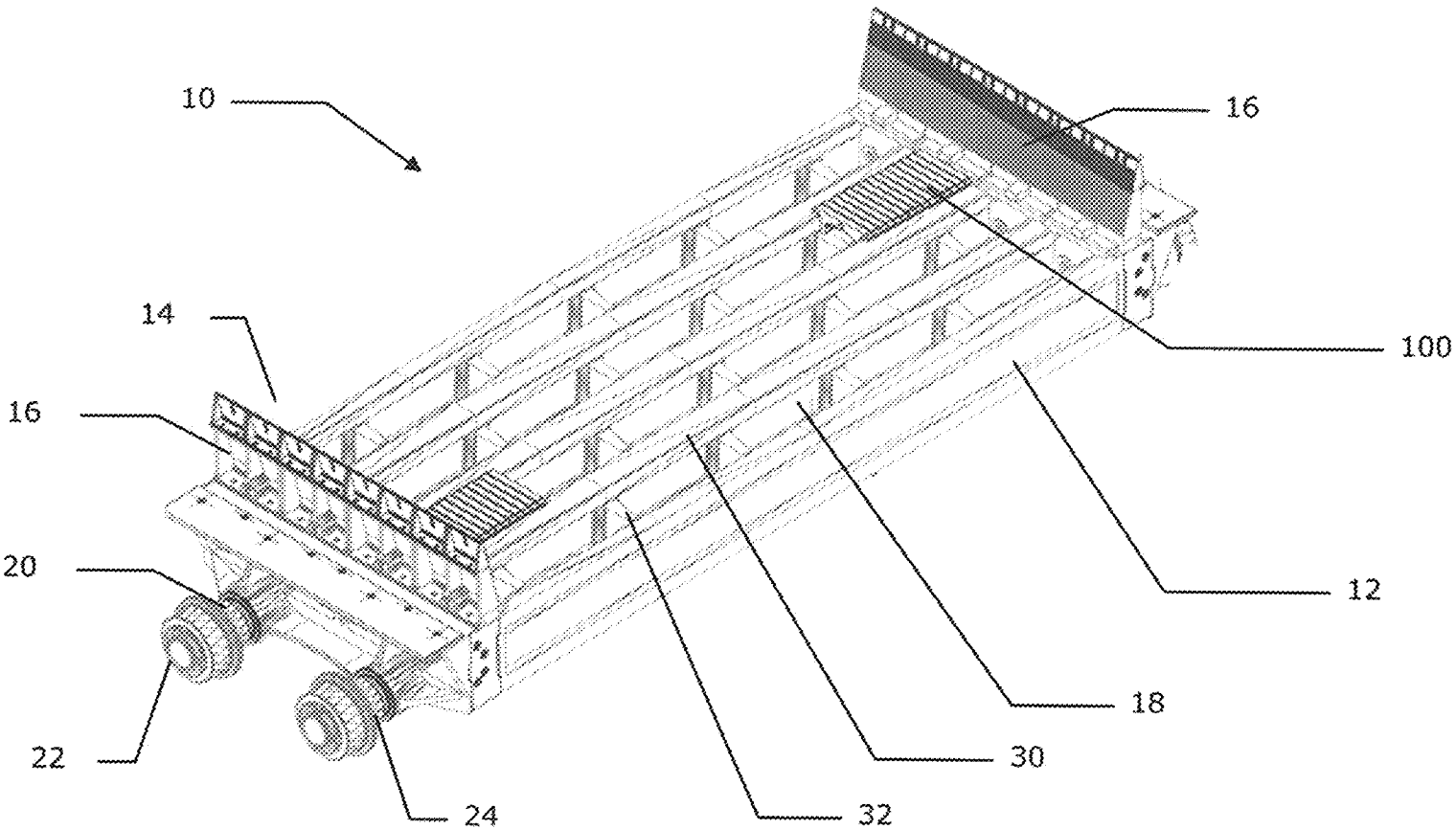
FIG. 2 is a perspective view of a pallet car which includes a grate bar in accordance with an embodiment of the invention.

Various embodiments of grate bars for use with a sintering pallet car of a pellitizing machine for producing ore pellets are depicted in FIGS. 2 through 7. As shown in FIG. 2 an individual pallet car 10 comprises a frame 12 for supporting a loading bay 14 for carrying bulk material (not shown) to be treated by the pellitizing machine (not shown). The loading bay 14 is formed from two opposing pallet car walls 16 and a floor 18 made up of a number of individual grate bars 100. The frame 12 is itself is supported by a track assembly 20 comprising track rollers 22 and pressure roller bearings 24. Track rollers 22 rollably support the pallet car 10 on an endless track (not shown). Pressure roller bearings 24 releasably engage drive wheels and driven wheels (not shown) of the pelletizing machine to propel the car 10 on the endless track.

As depicted in Hg. 2, the frame 12 is formed from a plurality of struts 30 that extend from one side to the other side of the car 10. Struts 30 are connected to adjacent struts 30 by ribs 32. An individual grate bar 100 is laid over top of the frame 12 and is supported by the struts 30. A plurality of grate bars 100 (also known as a grate bar assembly) will be understood to form the floor 18 of the loading bay 14.

An individual grate bar 100 will now be described in more detail with reference to FIGS. 3-5. Grate bar 100 comprises an elongate body 110, a pair of opposed arms 200, and a pair of opposed feet 300. Body 110 includes a central portion 112 and has a substantially planar top surface 114 for supporting bulk material to be treated.

Each one of the pair of arms 200 extends away from the central portion 112 of the body 110 so that each one of the pair of arms 200 is an opposed relationship to the other pair of arms 200. Each arm 200 has an underside 202 and a pair of peripheral spacers 210. Peripheral spacers 210 are rectangular and comprise a top wall 212, bottom wall 214, and a sidewall 216, Top wall 212 is recessed a distance r from the plane defined by the top surface 114 of grate bar 100. In some embodiments, having a recessed top wall 212 increases the movement of air through the grate bar 100. In the embodiment shown in FIGS. 3-5, the plane defined by the top wall 212 is about 0.6" below the plane defined by the top surface 114 of grate bar 100.

Figure 3:
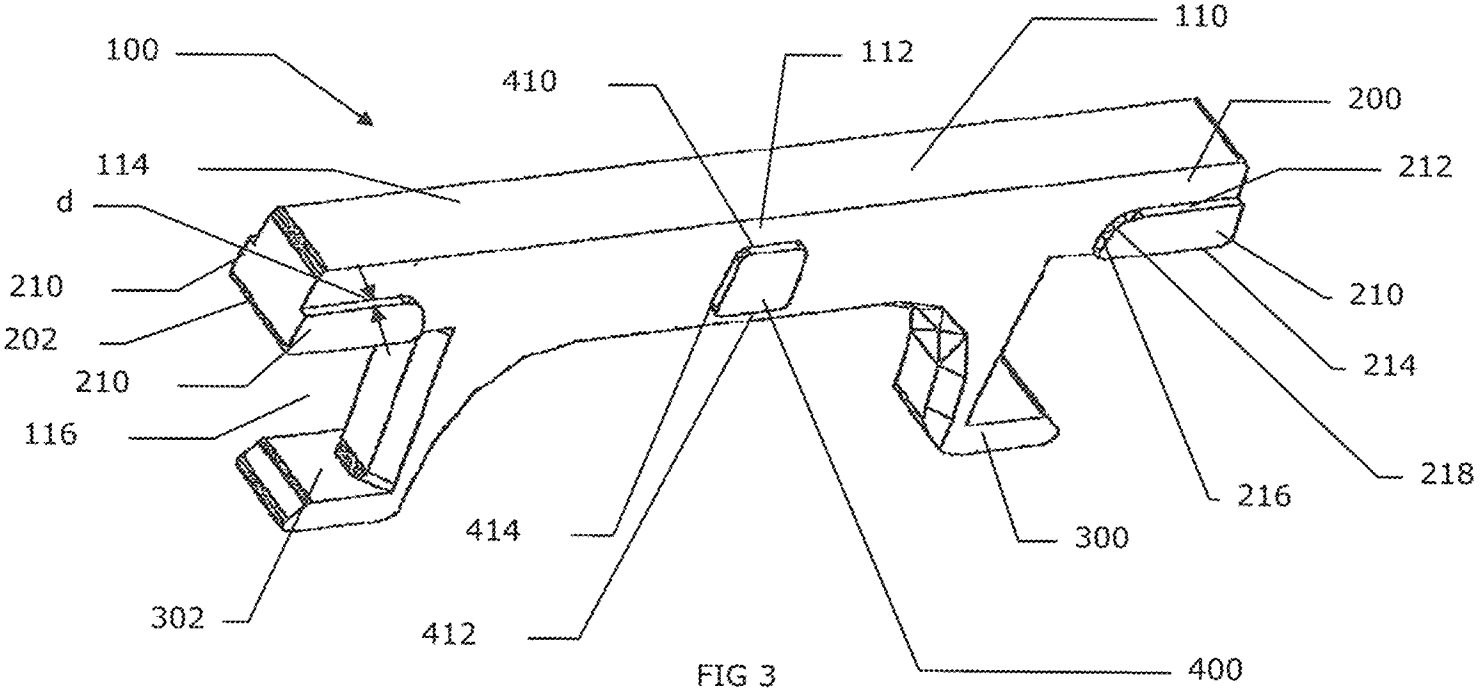
FIG. 3 is a front perspective view of the grate bar in accordance with an embodiment of the invention.
Figure 4:
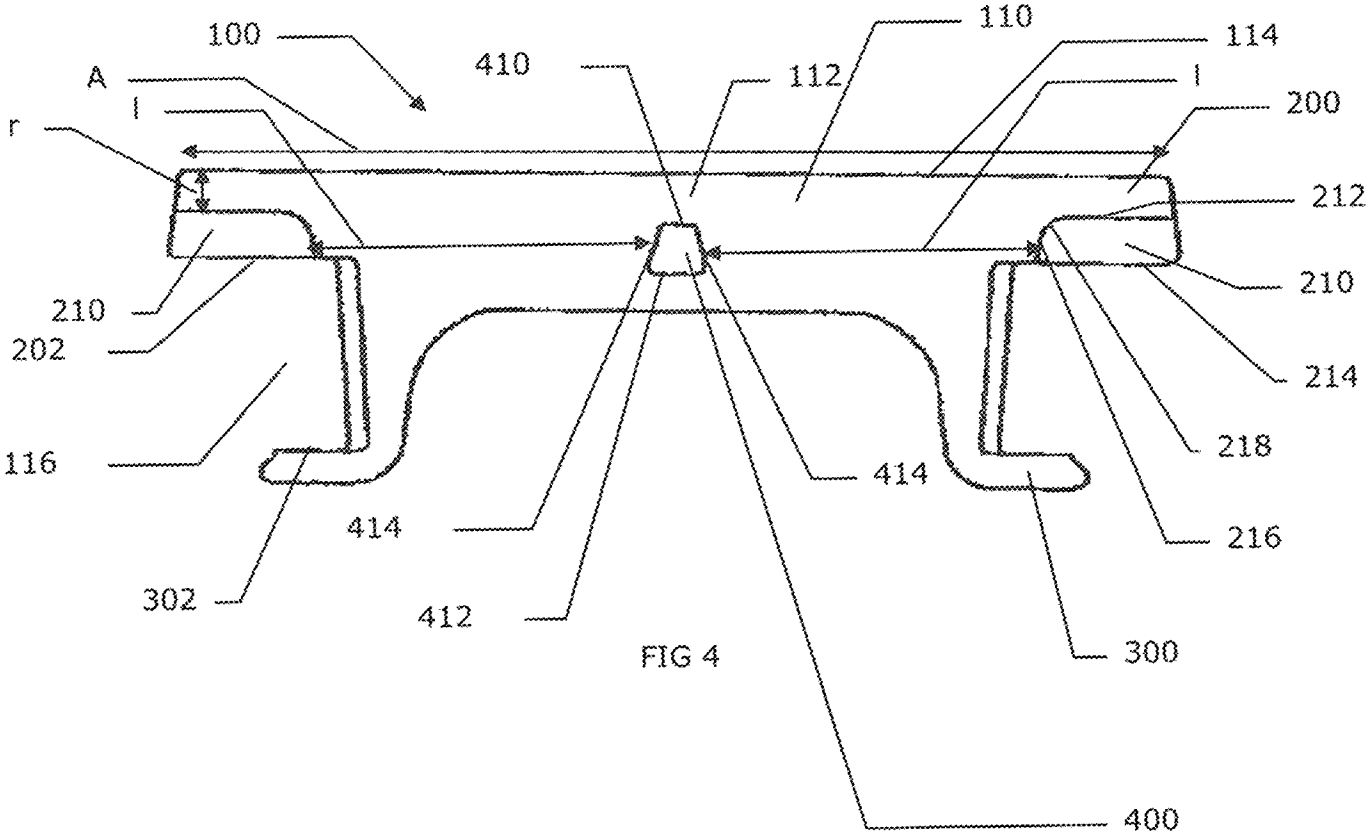
FIG. 4 is a front elevation view of the grate bar of FIG. 3.

As depicted in FIGS. 3-4, each peripheral spacer 210 extends laterally (lateral is understood as being in a direction orthogonal to the longitudinal axis of the body 110), a certain distance, away from the body 110 in opposing directions. In the embodiment depicted in FIGS. 3-5, the peripheral spacers 210 extend laterally away from the body 110 by a spacer width d—of about 0.125".

The top wall 212 and the side wall 216 may be joined at angles between around 5-15 degrees from the normal axis (the normal axis is defined as the line drawn from top to bottom and perpendicular to the plane of the top surface 114 of the body 110). In the embodiment depicted in FIGS. 3-5, the angle between formed between the top wall 212 and the sidewall 216 is about 10 degrees from the normal and the top wall 212 and the side wall 216 are joined by a rounded edge 218. It will be appreciated that the angle formed between the bottom wall 214 and the side wall 216 will also be about 10 degrees from the normal since the top wall 212 and the bottom wall 214 are parallel. In some embodiments, the angling of the peripheral spacers 210 may increase and direct air flow.

Figure 5:
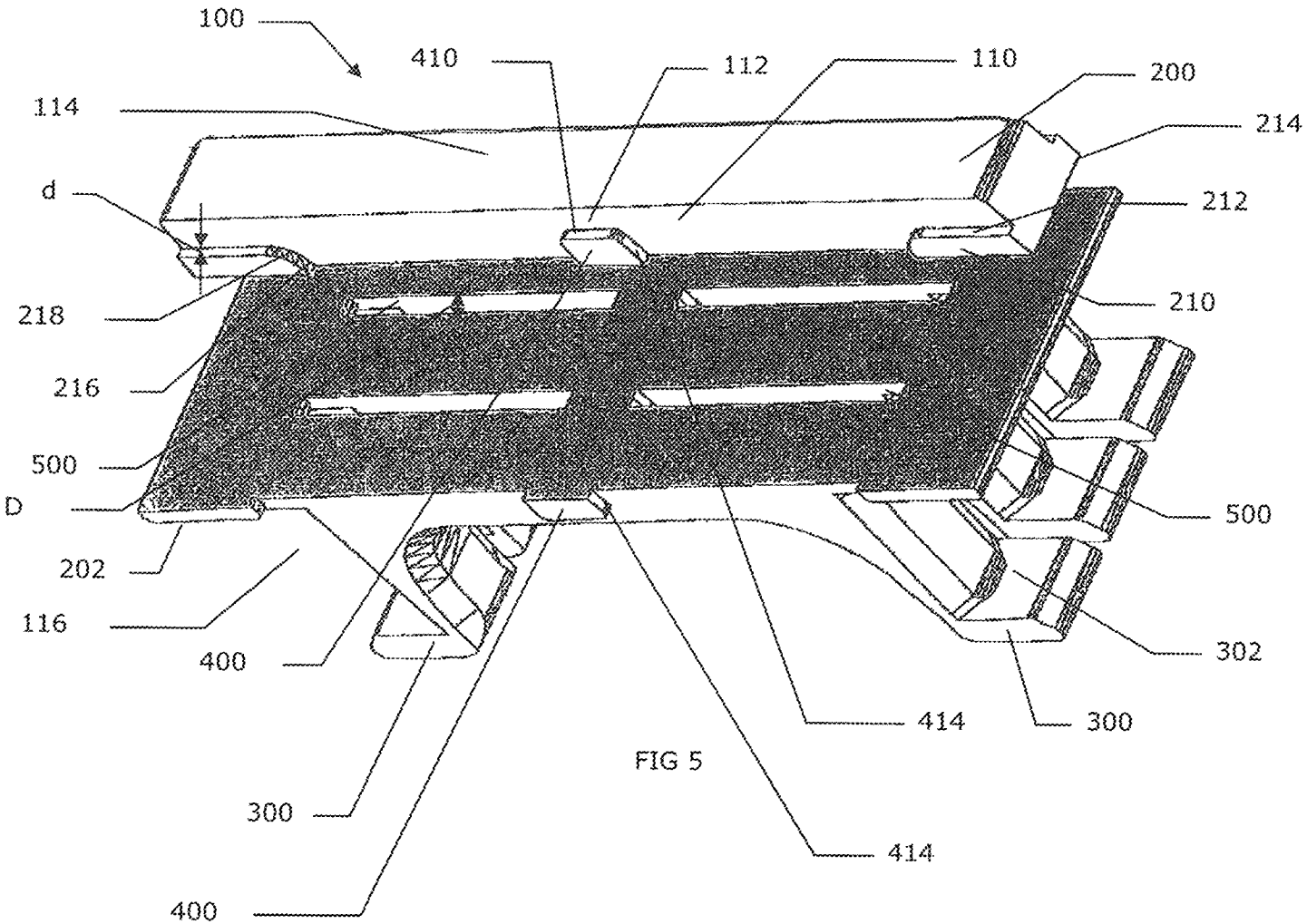
FIG. 5 is an exploded partial cross sectional view of a grate bar assembly comprising 3 grate bars arranged in a side-by-side configuration.
Figure 6:
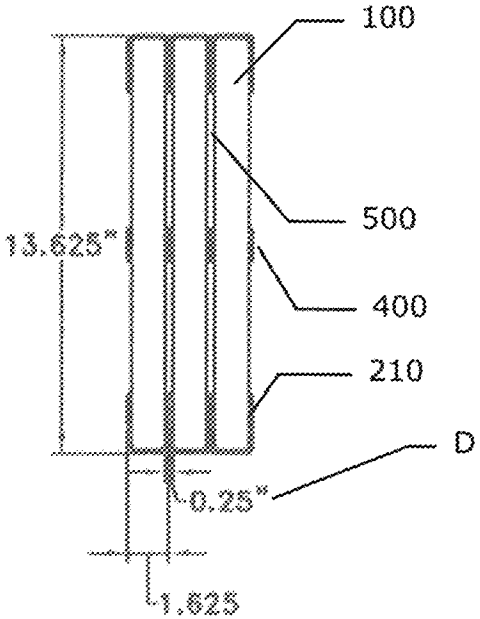
FIG. 6 is a top plan view of a grate bar assembly comprising 3 grate bars arranged in a side-by-side configuration in accordance with an embodiment of the invention.
Figure 7:
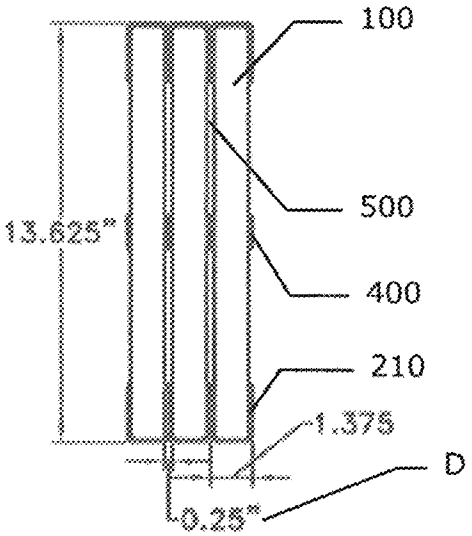
FIG. 7 is a top plan view of grate bar assembly comprising 3 grate bars arranged in a side-by-side configuration in accordance with a further embodiment of the invention.

The pair of feet 300 extends away from the body 110 as shown in the embodiment depicted in FIGS. 3-5. Each foot 300 has a topside 302. It may be understood that on either side of the body 110, each arm 200 and foot 300 are paired. A space 116 is defined by the underside 202 and the topside 302 directly below the underside 202. The space 116 formed by the arm 200 and foot 300 pair is dimensioned for receiving one strut 30 of the frame 12. It will be appreciated that in the embodiment shown, each the arm 200 and foot 300 pair is configured to secure the grate bar 100 to the pallet car 10 whether the pallet car 10 is in an upright position, inverted position, or any position therebetween.

A pair of central spacers 400 is located intermediate the ends of the body 110 and comprises a top wall 410, a bottom wall 412, and sidewalls 414. Top wall 410 is recessed a distance r from the plane defined by the top surface 114 of grate bar 100. In some embodiments, having a recessed top wall 410 increases the movement of air through the grate bar 100. In the embodiment shown in FIGS. 3-5, the plane defined by the top wall 410 is about 0.6" below the plane defined by the top surface 114 of grate bar 100.

Central spacers 400 extend laterally, a certain distance, away from the body 110 in opposing directions. In the embodiment depicted in FIGS. 3-5, the central spacers 400 extend laterally away from the body 110 by the spacer width d of about 0.125" away from the body 110.

In the embodiment depicted in FIGS. 3-5, sidewalls 414 of the central spacer 400 flare outwards and the distance between the sidewalls 414 increases moving in a downwards direction from the top to the bottom up to a maximum. In the embodiment depicted, central spacer 400 assumes a trapezoidal form and the angle formed between the sidewall 414 and the bottom wall 412 is about 10 degrees from either side of the normal. In other embodiments, it will be appreciated that the sidewall 414 and the bottom wall 412 and be joined at angles between around 5-15 degrees from the normal.

Although central spacers 400 are depicted in FIGS. 3-5 as having a trapezoidal form, it will be appreciated that central spacers 400 may assume other known shapes where the distance between the sidewalls 414 increases moving in a downwards direction from the top to the bottom up to a maximum length with the sidewalls 414 flaring outwards. The angle formed between the sidewall 414 and the normal axis at the region where the distance between the sidewall 414 is at a maximum is around 10±5 degrees from the normal. In some embodiments, the central spacers 400 may have an inverted "V" form such as for example, a four-point diamond, an inverted tear-drop, or triangular shape which in some embodiments, may increase and direct air flow.

In will be understood that in some embodiments, the outward flaring of sidewalls 414 increases the movement of air passing around and through grate bar 100. Additionally, the flaring of the sidewalls 414 also directs air flow to the bulk materials contained in the loading bay 14. The increased movement of air and the directed flow of air reduce the differential heating and cooling of the components of the pallet car 10, which in turn reduces maintenance and repair costs, as well as improve the quality and quantity of treated bulk materials.

Reference will now be made to FIG. 5, which shows a grate bar assembly comprising three grate bars 100 arranged in a side-by-side configuration and in contact with adjacent grate bars 100. It will be understood that a plurality of grate bars 100 arranged in a similar manner will form the floor 18 of the loading bay 14. For illustration purposes, the grate bar assembly has been sectioned into an upper portion and a lower portion and the upper portion of two of the three grate bars 100 in the grate bar assembly have been removed leaving behind one intact grate bar 100 and the lower portions of two grate bars 100.

A pair of adjacent grate bars 100 defines an air slot 500 that allows air to move between the upper and the lower portions of the grate bar 100 and hence through the floor 18. Each air slot 500 will have a gap width D (defined as being the sum of the spacer widths d of the two adjacent grate bars 100) and a gap length L (defined as being the combined distance (l+l) between peripheral spacer 210 and central spacer 400 from each pair of arms 200). It will be appreciated that air slots 500 are formed between adjacent grate bars 100 because the peripheral 210 and central spacers 400 of each grate bar 100 abut against the peripheral 210 and central spacers 400 of the adjacent grate bar 100. In embodiments, air slots 500 increase and direct air flow. In some embodiments this reduces the differential heating and cooling of the components of the pallet car 10 and in some embodiments, the increased air flow and directional cooling improves the quality and quantity of treated bulk materials.

EXAMPLE 1

A comparison of embodiments of the grate bar 100 of the invention is made with an example of conventional grate bar currently used in existing pallet cars is shown below.

TABLE 1

| | Prior art | CSP4814 | CSP5866 |
|---|---|---|---|
| Number of bars (4000 mm pallet) | 374 | 440 | 374 |
| Width of pallet car | 157.5 in | 157.5 in | 157.5 |
| Length of pallet car | 49 in (4 rows of bars × 12.25 in length of bar) | 49 in | 49 in |
| Total surface area of floor of the pallet car | 7717.5 $in^2$ (157.5 × 49) | 7717.5 $in^2$ | 7717.5 $in^2$ |
| Width of grate bar | 1.625 in | 1.375 in | 1.625 in |
| Length A of grate bar | 12.25 in | 13.625 in | 13.625 in |
| Spacer width d | 0.125 in | 0.125 in | 0.125 in |
| Width of air slots (gap width D) | 0.25 in | 0.25 in | 0.25 in |
| Total length of air slots (gap length L) | 8.5 in | 10.188 in | 10.188 in |
| Open area for air flow | 8.5 × 0.25 = 2.125 in | 10.188 × 0.25 = 2.547 $in^2$<br>3.00 × 0.25 = 0.75<br>0.75 × 0.60<br>(40%) = 0.45 $in^2$<br>2.547 $in^2$ + 0.45 $in^2$ = 2.977 $in^2$<br>per bar | 10.188 × 0.25 = 2.547 $in^2$<br>3.00 × 0.25 = 0.75<br>0.75 × 0.60<br>(40%) = 0.45 $in^2$<br>2.547 $in^2$ + 0.45 $in^2$ = 2.977 $in^2$<br>per bar |
| Total open area for air flow | 2.125 × 374 bars = 794.75 $in^2$ | 2.977 × 440 bars = 1318.68 $in^2$ | 2.977 × 374 bars = 1120.87 $in^2$ |
| Percentage increase in air flow | — | 7.83 | 5.7 |
| Percentage of open area to total surface area | 10.3% | 14.5 to 18.9% | 12.3 to 16.1% |

It will be appreciated that in the embodiments of the grate bar 100 shown in table 1 and in FIGS. 2-7, the grate bar 100 of the present disclosure is thinner and longer than existing grate bars. For instance, in a typical 4000 mm pallet car, there are 374 grate bars. By using an embodiment of the grate bar 100 of the present invention in a grate bar assembly, the user would be able to install 440 grate bars 100 in a 4000 mm pallet car—an increase of 66 grate bars. In some embodiments, the grate bars 100 are thinner than existing grate bars. As a consequence, an assembly of individual grate bars 100 which will form the floor 18 will have an increased total open area for air flow than currently existing grate bars used to form floor 18. In the embodiment shown in Table 1, this would result in a total open air flow of 1318.68 $in^2$ as compared to 1120.87 $in^2$ in a 4000 mm pallet car.

It will be appreciated that in further embodiments, the grate bar 100 of the present disclosure provides for a total open area for air flow of between 1120.68 to 1459.15 $in^2$ and 952.58 to 1240.26 $in^2$ in a 4000 mm pallet car.

In some embodiments, the increased and directed air flow reduces the differential heating and cooling of the components of the pallet car 10 which in turn reduces maintenance and repair costs. Additionally, in some embodiments, the increased air flow and directional cooling improves the quality and quantity of treated bulk materials.

The embodiments of the present application described above are intended to be examples only. Those of skill in the art may effect alterations, modifications and variations to the particular embodiments without departing from the intended scope of the present application. In particular, features from one or more of the above-described embodiments may be selected to create alternate embodiments comprised of a subcombination of features which may not be explicitly described above. In addition, features from one or more of the above-described embodiments may be selected and combined to create alternate embodiments comprised of a combination of features which may not be explicitly described above. Features suitable for such combinations and subcombinations would be readily apparent to persons skilled in the art upon review of the present application as a whole. Any dimensions provided in the drawings are provided for illustrative purposes only and are not intended to be limiting on the scope of the invention. The subject matter described herein and in the recited claims intends to cover and embrace all suitable changes in technology.

The invention claimed is:

1. A grate bar for use in forming a grate bar assembly of a sintering pallet car, the assembly including a plurality of grate bars arranged in a side-by-side configuration, the grate bar comprising:

an elongate body having a top surface for receiving a load, a pair of opposed arms, and a pair of opposed feet, wherein each arm and foot pair retain the frame of the car therebetween;

a pair of peripheral spacers at an end of each arm, wherein each one of the pair of the peripheral spacers extends laterally away from the body to distance the body from a body of an adjacent grate bar, each one of the pair of peripheral spacers comprise:

a peripheral spacer top wall, a peripheral spacer bottom wall, and a peripheral spacer side wall joining the peripheral spacer top wall to the peripheral spacer bottom wall; and a pair of central spacers located between the peripheral spacers, each one of the pair of central spacers extends laterally away from the body to distance the body from the body of the adjacent grate bar, each one of the pair of central spacers comprises:

a central spacer top wall, a central spacer bottom wall, and a pair of central spacer sidewalls joining the central spacer top wall to the central spacer bottom wall, and wherein a distance between the pair of central spacer sidewalls increases to a maximum distance at the central spacer bottom wall moving downwards from the central spacer top wall to the central spacer bottom wall.

2. The grate bar of claim 1 wherein the peripheral spacer top wall defines a peripheral spacer top wall plane, the central spacer top wall defines a central spacer top wall defines a central spacer top wall plane, and the top surface of the elongate body defines an elongate body top surface plane; and wherein at least one of the peripheral spacer top wall plane and the central spacer top wall plane is below the elongate body top surface plane.

3. The grate bar of claim 1 wherein an angle formed between the central spacer sidewalls and the central spacer bottom wall at a region of maximum distance between the central spacer sidewalls is around 10 ±5 degrees from the normal axis.

4. The grate bar of claim 1 wherein the central spacers are trapezoidal.

5. The grate bar of claim 2 wherein at least one of the peripheral spacer top wall plane and the central spacer top wall plane is about 0.6 inches below the elongate body top surface plane.

6. The grate bar of claim 1 wherein the peripheral spacer top wall and the peripheral spacer side wall intersect at a rounded edge.

7. The grate bar of claim 1 wherein the peripheral spacer top wall and the peripheral spacer side wall are joined at about 5 to 15 degrees from the normal axis.

8. The grate bar of claim 7 wherein the peripheral spacer top wall and the peripheral spacer side wall are joined at 10 degrees from the normal axis.

9. The grate bar of claim 1 wherein a distance between ends of the pair of opposed arms is about 13.625 inches, each one of the pair of the peripheral spacers and central spacers extend laterally about 0.125 inches away from the body, the width of the body is 1.125 inches, and a combined distance between the peripheral spacer side walls and the central spacer side walls about 10.188 inches.

10. A grate bar assembly for use in forming a floor of a pallet car, the car having a frame, the grate bar assembly comprising:

a plurality of grate bars secured to the frame to form a floor of a pallet car, the grate bars arranged in a side-by-side configuration, each one of the grate bars comprises:

an elongate body having a top surface for receiving a load, a pair of opposed arms, and a pair of opposed feet, wherein each arm and foot pair retain the frame of the car therebetween;

a pair of peripheral spacers at an end of each arm, wherein each one of the pair of the peripheral spacers extends laterally away from the body to distance the body from a body of an adjacent grate bar, each one of the pair of peripheral spacers comprise:

a peripheral spacer top wall, a peripheral spacer bottom wall, and a peripheral spacer side wall joining the peripheral spacer top wall to the peripheral spacer bottom wall;

a pair of central spacers located between the peripheral spacers, each one of the pair of central spacers extends laterally away from the body to distance the body from the body of the adjacent grate bar, each one of the pair of central spacers comprises:

a central spacer top wall, a central spacer bottom wall, arid a pair of central spacer sidewalls joining the central spacer top wall to the central spacer bottom wall, wherein a distance between the pair of central spacer sidewalls increases from the central spacer top wall to a maximum distance at the central spacer bottom wall;

an air slot formed between the elongate body of adjacent grate bars, wherein at least a pair of grate bars are aligned in a side-by-side configuration wherein the peripheral spacers and the central spacer of one of the pair of grate bars abuts against the respective peripheral spacers and the central spacer of another of the pair of grate bars, the air slot allowing movement of air through the floor, wherein a combined surface area of all the air slots comprise about 12.3% to about 18.9% of a total surface area of the floor.

11. The grate bar assembly of claim 10 wherein the combined surface area of all the air slots comprises about 17% of the total surface area of the floor.

12. The grate bar assembly of claim 10 wherein the combined surface area of all the air slots comprises about 14% of the total surface area of the floor.

13. The grate bar assembly of claim 10 wherein an angle formed between the central spacer sidewalls and the central spacer bottom wall at a region of maximum distance between the central spacer sidewalls is around 10±5 degrees from the normal axis.

14. The grate bar assembly of claim 10 wherein the central spacers are trapezoidal in shape.

15. The grate bar assembly of claim 10 wherein the peripheral spacer top wall defines a peripheral spacer top wall plane, the central spacer top wall defines a central spacer top wall plane, and the top surface of the elongate body defines an elongate body top surface plane; and wherein at least one of the peripheral spacer top wall plane and the central spacer top wall plane is below the elongate body top surface plane.

16. The grate bar assembly of claim 10 wherein the peripheral spacer top wall and the peripheral spacer side wall intersect at a rounded edge.

17. The grate bar assembly of claim 10 wherein the peripheral spacer top wall and the peripheral spacer side wall are joined at about 5 to 15 degrees from the normal axis.

18. The grate bar assembly of claim 17 wherein the peripheral spacer top wall and the peripheral spacer side wall are joined at 10 degrees from the normal axis.

19. The grate bar assembly of claim 10 wherein a distance between ends of the pair of opposed arms is about 13.625 inches, each one of the pair of the peripheral spacers and central spacers extend laterally about 0.125 inches away from the body, the width of the body is 1.125 inches, and a combined distance between the peripheral spacer side walls and the central spacer side walls about 10.188 inches.

20. A grate bar assembly for use in forming a floor of a pallet car, the car having a frame, the grate bar assembly comprising:

a plurality of grate bars securable to the frame, each grate bar comprising:

an elongate body having a top surface for receiving a load, a pair of opposed arms, and a pair of opposed feet, wherein each arm and foot pair retain the frame of the car therebetween;

a pair of peripheral spacers at an end of each arm, wherein each one of the pair of the peripheral spacers extends laterally away from the body to distance the body from a body of an adjacent grate bar, each one of the pair of peripheral spacers comprise:

a peripheral spacer top wall, a peripheral spacer bottom wall, and a peripheral spacer side wall joining the peripheral spacer top wall to the peripheral spacer bottom wall; and a pair of central spacers located between the peripheral spacers, each one of the pair of central spacers extends laterally away from the body to distance the body from the body of the adjacent grate bar, each one of the pair of central spacers comprises:

a central spacer top wall, a central spacer bottom wall, and a pair of central spacer sidewalls joining the central spacer top wall to the central spacer bottom wall, and wherein a distance between the pair of central spacer sidewalls increases to a maximum distance at the central spacer bottom wall moving downwards from the central spacer top wall to the central spacer bottom wall;

a plurality of air slots formed between at least a pair of grate bars in a side-by-side configuration, wherein the peripheral spacers and the central spacer of one of the pair of grate bars abut against the respective peripheral spacers and the central spacer of another of the pair of grate bars; and wherein the plurality of air slots configured to allow air to flow between the pair of grate bars and between the top and bottom of the grate bar assembly.

21. The grate bar assembly of claim 19, wherein the peripheral spacer top wall defines a peripheral spacer top wall plane, the central spacer top wall defines a central spacer top wall plane, and the top surface of the elongate body defines an elongate body top surface plane; and wherein at least one of the peripheral spacer top wall plane and the central spacer top wall plane is below the elongate body top surface plane.

22. The grate bar assembly of claim 20 wherein the at least one of the peripheral spacer top wall plane and the central spacer top wall plane is about 0.6 inches below the elongate body top surface plane.

23. The grate bar assembly of claim 19 wherein a combined surface area of the plurality of air slots comprises about 12.3% to about 18.9% of a total surface area of the floor.

24. The grate assembly of claim 19 wherein an angle formed between the central spacer sidewalls and the central spacer bottom wall at a region of maximum distance between the central spacer sidewalls is around 10±5 degrees from the normal axis.

25. The grate assembly of claim 19 wherein the central spacers are trapezoidal in shape.

26. The grate assembly of claim 19 wherein each of the peripheral spacers and the central spacer extends laterally a distance d away from the body and the air slot has a width D, which is about two times the distance d.

* * * * *